US010323609B1

(12) United States Patent
Collins et al.

(10) Patent No.: US 10,323,609 B1
(45) Date of Patent: Jun. 18, 2019

(54) CONFIGURABLE ENGINE MANIFOLD

(71) Applicant: RB DISTRIBUTION, INC., Colmar, PA (US)

(72) Inventors: Timothy Collins, Oxford, MI (US); Donald Carbone, Rochester Hills, MI (US); Patrick Kennedy, Perkasie, PA (US); Michael Capko, Harleysville, PA (US)

(73) Assignee: RB Distribution, Inc., Colmar, PA (US)

( * ) Notice: Subject to any disclaimer, the term of this patent is extended or adjusted under 35 U.S.C. 154(b) by 0 days.

(21) Appl. No.: 15/863,349

(22) Filed: Jan. 5, 2018

(51) Int. Cl.
*F02M 35/10* (2006.01)
*F02M 35/104* (2006.01)

(52) U.S. Cl.
CPC .... *F02M 35/104* (2013.01); *F02M 35/10222* (2013.01); *F02M 35/10255* (2013.01)

(58) Field of Classification Search
CPC ..... F02M 35/104; F02M 35/10222; F02M 35/10255
USPC ..... 123/184.21–183.61, 572
See application file for complete search history.

(56) References Cited

U.S. PATENT DOCUMENTS 5,950,586 A * 9/1999 Ropertz ..... F02B 27/00 123/184.21
6,167,855 B1 * 1/2001 Mammarella ..... F02F 7/006 123/184.21
6,807,957 B2 * 10/2004 Ko ..... F02M 25/06 123/184.21
2006/0016416 A1 1/2006 Kim et al.
2006/0191505 A1 * 8/2006 Doko ..... F02M 35/10039 123/184.59
2007/0039583 A1 * 2/2007 Lewis ..... F01M 13/02 123/184.35
2009/0266326 A1 * 10/2009 Durkin ..... F01M 13/022 123/184.22
2011/0005488 A1 * 1/2011 Reese ..... F02M 35/10039 123/184.61
2011/0132310 A1 * 6/2011 Born ..... F02M 35/10019 123/184.21
2012/0291741 A1 * 11/2012 Ito ..... F02M 35/10052 123/184.47
2014/0216387 A1 * 8/2014 Kulkarni ..... F02M 35/1045 123/184.47
2015/0128884 A1 * 5/2015 Pursifull ..... F02M 35/10229 123/2
2016/0169171 A1 * 6/2016 Newman ..... F02M 35/10373 180/68.3
2016/0201620 A1 * 7/2016 Yano ..... F02M 35/10321 123/184.27

* cited by examiner

*Primary Examiner* — Marguerite J McMahon
(74) *Attorney, Agent, or Firm* — Volpe and Koenig, P.C.

(57) ABSTRACT

An engine intake manifold kit having a plurality of common components is selectively configured to conform to either a truck configuration or a car configuration.

1 Claim, 12 Drawing Sheets

CONFIGURABLE ENGINE MANIFOLD

FIELD OF INVENTION

The present invention pertains to the field of engine intake manifolds. It particularly pertains to preformed manifold parts that can be configured to provide specific engine intake manifolds suitable for application to a plurality of vehicles.

BACKGROUND

The intake manifold designed by the original equipment manufacturer (OEM) generally prioritizes performance for a particular vehicle without regard to complexity of the manifold's design or cost. One such OEM intake manifold has seven molded elements that require four different welds and eleven discrete manufacturing processes to assemble a manifold. Because OEM intake manifolds are also specific to a particular vehicle, vehicle trim line, and/or engine option, different vehicles utilizing the same engine block may still have multiple permutations of the manifold in order to match the specifics of that vehicle. This variation results in multiple product SKUs that necessitate increased handling and storage space. This variation also cause the aftermarket replacement manifolds to be more difficult to produce and expensive.

The aftermarket desires a solution to the prior art problems that reduces the number of parts and simplifies the manufacturing process with resulting efficiencies in inventory management.

SUMMARY

The present disclosure is directed to providing configurable common parts or components that are compatible for the assembly of different manifolds that are vehicle specific. The common parts or components include a base assembly, a throttle body, a PCV adaptor, and an oil fill adaptor. The common base assembly has open and closed ends, a throttle body mount location, and at least two ports. The ports are each located at respective ends of the base assembly. A vehicle specific manifold is configured by identifying the specific locations of a vehicle's throttle body, PCV adaptor and oil fill adaptor according to the specific vehicle application.

BRIEF DESCRIPTION OF THE DRAWINGS

The following detailed description will be better understood when read in conjunction with the appended drawings, which illustrate a preferred embodiment of the invention. In the various drawing, like numbers identify identical or functionally similar structural elements.

DETAILED DESCRIPTION OF THE PREFERRED EMBODIMENTS

Figure 1:
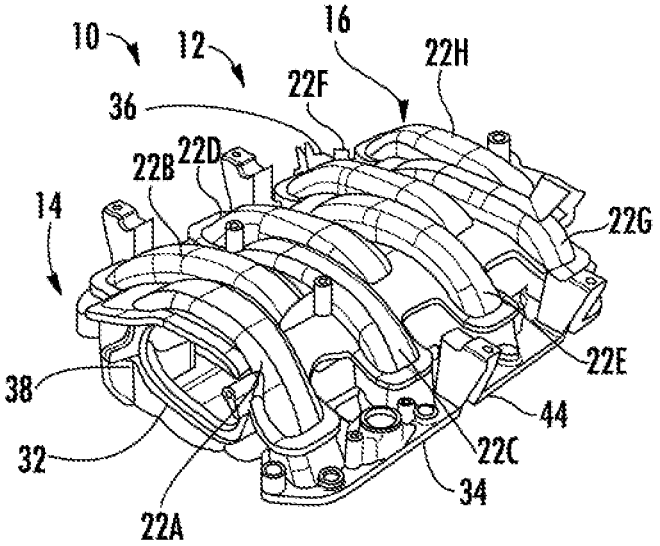
FIG. 1 is a perspective view of a shell for an intake manifold assembly.

Certain terminology is used in the following description for convenience only and is not to be considered a limitation. Words such as "front", "back", "top" and "bottom" designate directions with reference to the drawing referenced.

The term "vehicle" includes cars, SUVs, crossovers, and trucks. Those skilled in the art will recognize that a car has relatively low ground clearance and a smaller engine compartment in comparison to an SUV, crossover, or truck that has relatively higher ground clearance as the vehicle's size increases. The result of this variation is a spatial consideration that frequently requires different arrangements of the manifold components, such as the throttle body, oil fill adaptor and PCV adaptor, to accommodate the available engine compartment.

Figure 2:
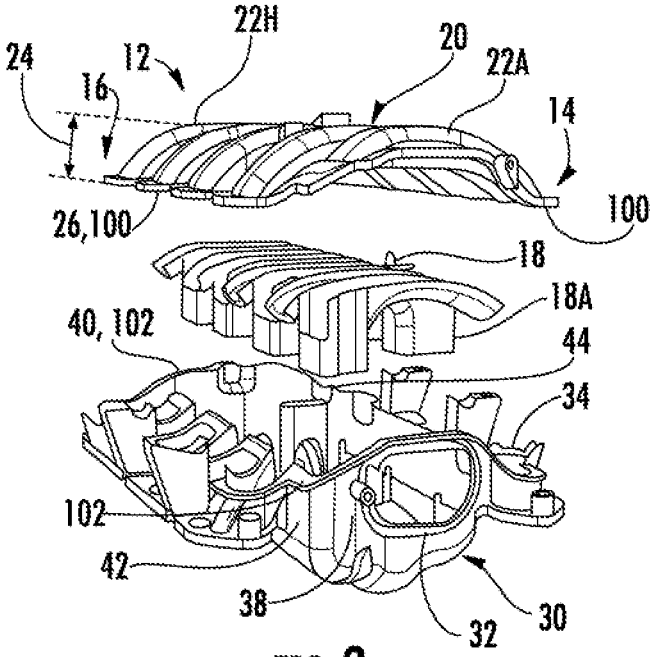
FIG. 2 is an exploded perspective view of the shell of FIG. 1.

FIGS. 1 and 2 illustrate the components of a base assembly 12 that is common to all intake manifolds 10. The base assembly 12 has an opened intake end 14, a closed end 16, an inner shell 18 member, an upper shell member 20, and a lower shell member 30.

As shown in FIG. 1, the base assembly 12 is dimensioned to fit carious OEM applications and includes mounting holes, insert and stand offs according to the OEM configuration for the manifold.

Still with reference to FIGS. 1-2, the upper shell 20 has a plurality of longitudinally spaced crossing members 22A-H that extend laterally across the upper shell 20 and define the height 24 of the upper shell 20 above the bottom side 26. Although the height 24 is greater than that of a conventional OEM Hemi truck manifold, it is less than that of a conventional OEM Hemi car manifold, which facilitates the use of the configurable manifold in both car and truck engine compartments. The inner shell 18 has a plurality of legs or stand offs 18A that locate it between upper and lower shell members 20 and 30.

Figure 3:
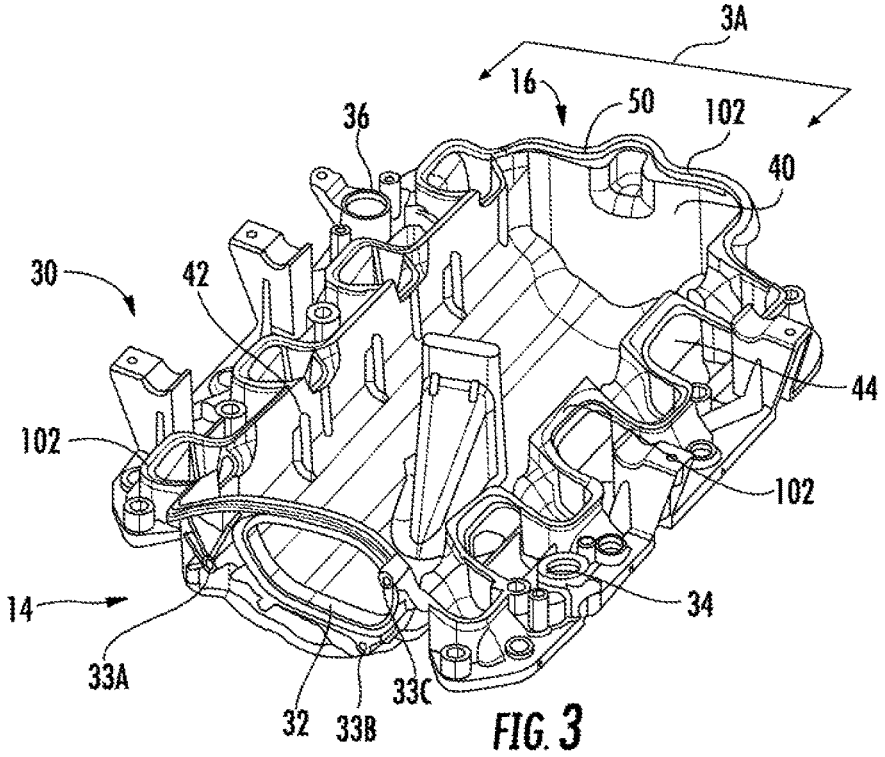
FIG. 3 is an open view into the lower portion of the shell in FIG. 2.

With reference to FIG. 3, the lower shell 30 has an open intake end wall 14, a closed end wall 40 and spaced apart sidewalls 42 and 44 that define an interior recess or valley in the lower shell 30 beneath the inner member 18. Shell 30 also includes a throttle body mounting opening 32, a first port 34 to one side and closer to intake end 14, and a second port 36 to and to the other side and closer to the end 16. The throttle body mounting opening 32 is preferably integrally formed as part of the end wall 38 and is surrounded by a plurality of fasteners receiving apertures 33A-C.

Figure 3A:
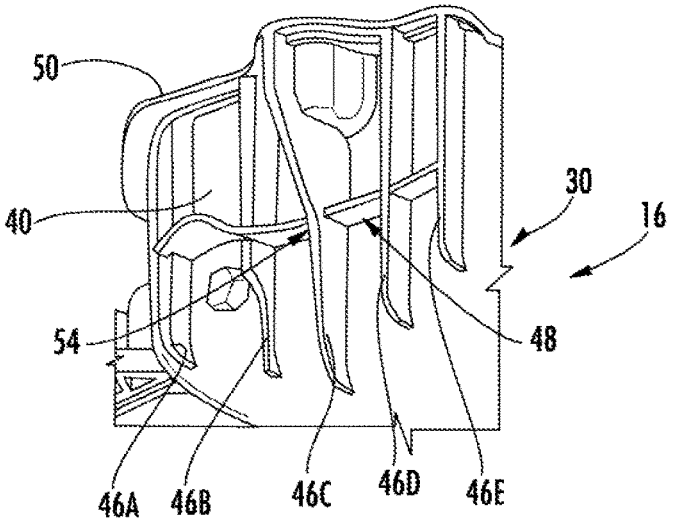
FIG. 3A illustrates a section of the back wall of the lower portion of the shell looking in the direction of the line 3A in FIG. 3.

As best shown in segmented shown in FIG. 3A, the closed end wall 40 of the lower shell 30 includes a plurality of ribs, vertical ribs 46A-E and horizontal rib 48, to distribute stresses and prevent concentrations of stress in the area. The vertical ribs 46A-E extend from an upper lip 50 and terminate proximate a lower end 52 of the lower shell 30. Preferably, the vertical ribs are formed integrally with the molding of the lower shell 30. The central vertical rib 46C is continuously curved outwardly from the point of connection 54 with the transverse rib 48. Although ribs 46A-E are only illustrated in the end wall 40, however, similar ribs may be provided in other areas of the lower shell 30 where stress concentrations are an issue. The specific shapes and locations of the ribs in this example were selected in accordance with the geometry of an existing manifold for an OEM Hemi engine.

Figure 4:
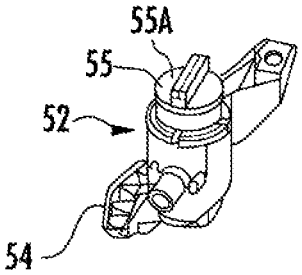
FIG. 4 illustrates an oil fill adaptor for the manifold assembly.
Figure 5:
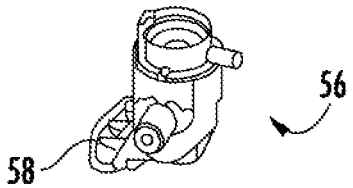
FIG. 5 illustrates a PCV adaptor for the manifold assembly.

FIG. 4 shows an oil fill adaptor 52 that includes a mount 54 and a fill opening 55. The oil fill opening 55 is sized in each configurations to receive an OEM oil fill cap 55A intended for use with a car application, as further discussed below. FIG. 5 shows a positive crankcase ventilation (PCV) adaptor 56 including a mount 58. The mounts 54 and 58 are configured and sized so that either adaptor, 52 or 56, can be selectively mount to either port 34 or port 36 of lower shell 30 without modification or any further adaptor element.

Figure 12:
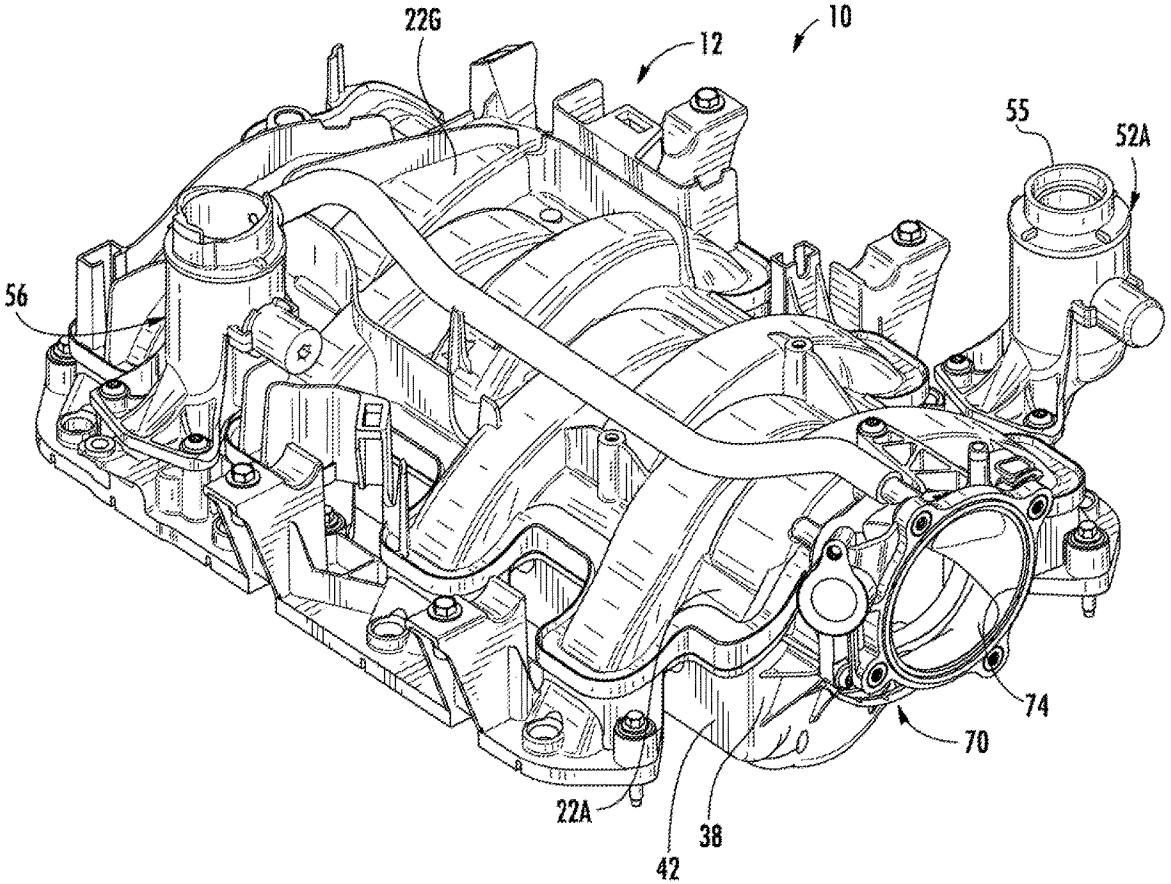
FIG. 12 is a perspective view illustrating one configuration of an assembled intake manifold.
Figure 13:
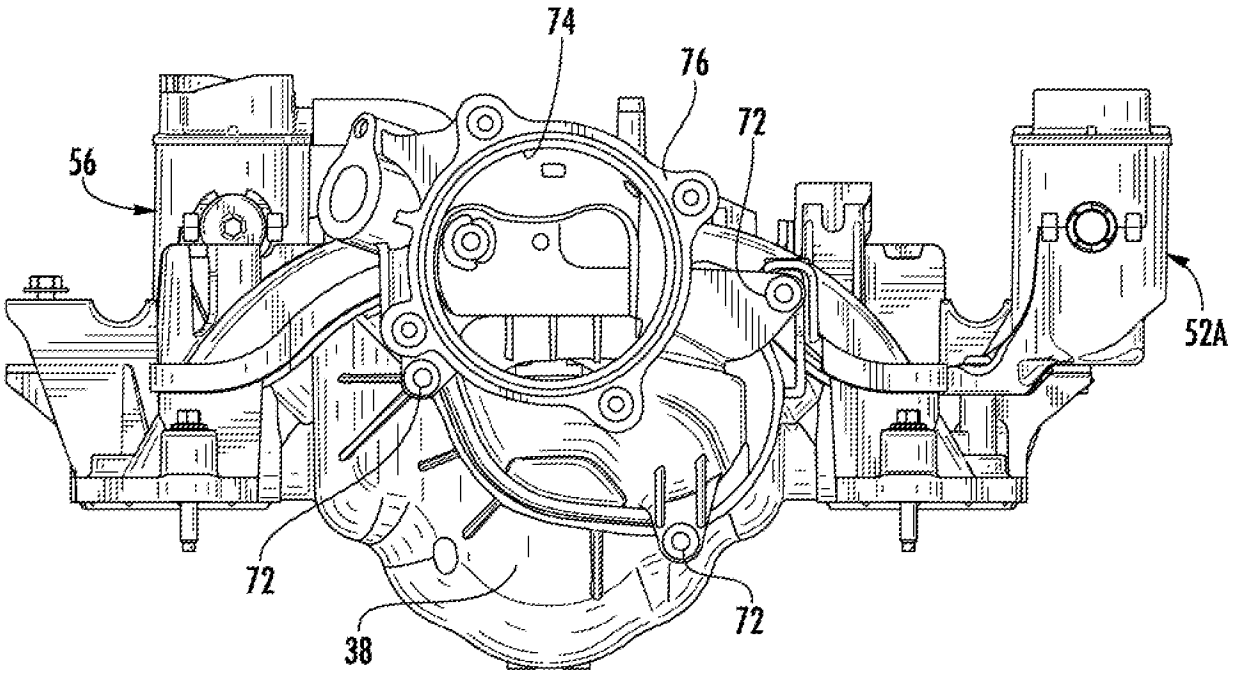
FIG. 13 is a front elevation view of the intake manifold assembly of FIG. 12.
Figure 14:
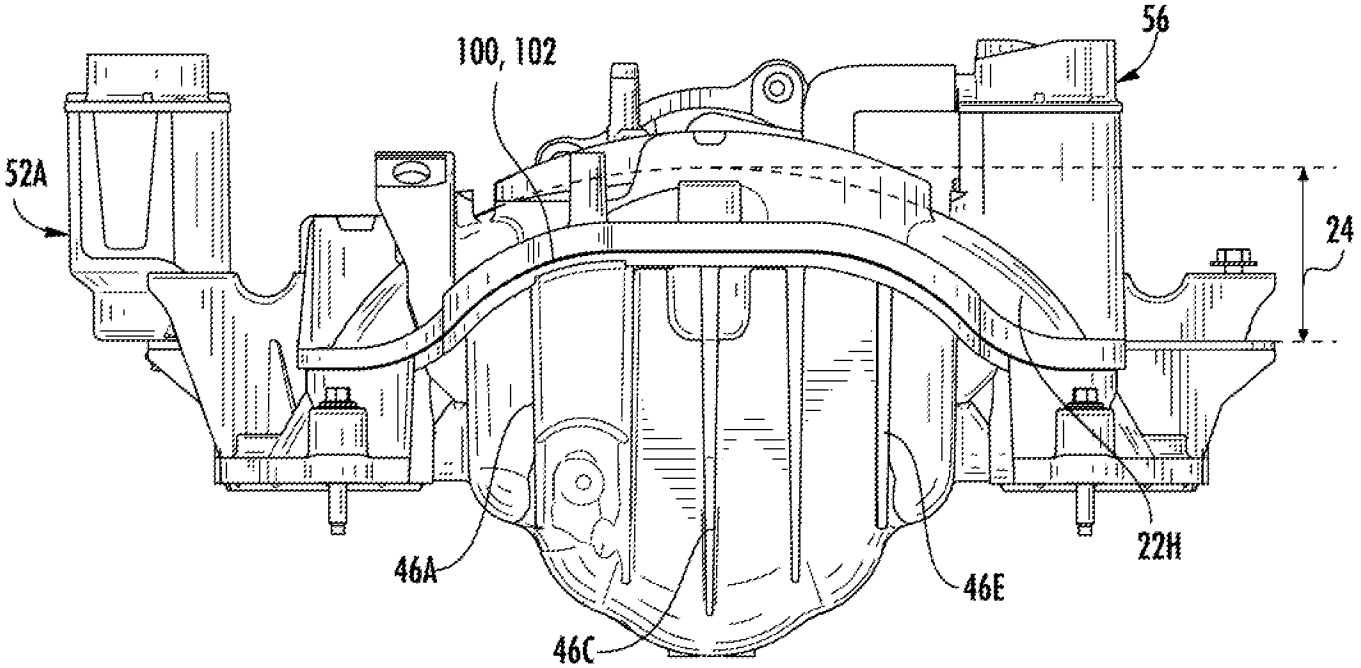
FIG. 14 is a rear elevation view of the intake manifold assembly of FIG. 12.
Figure 15:
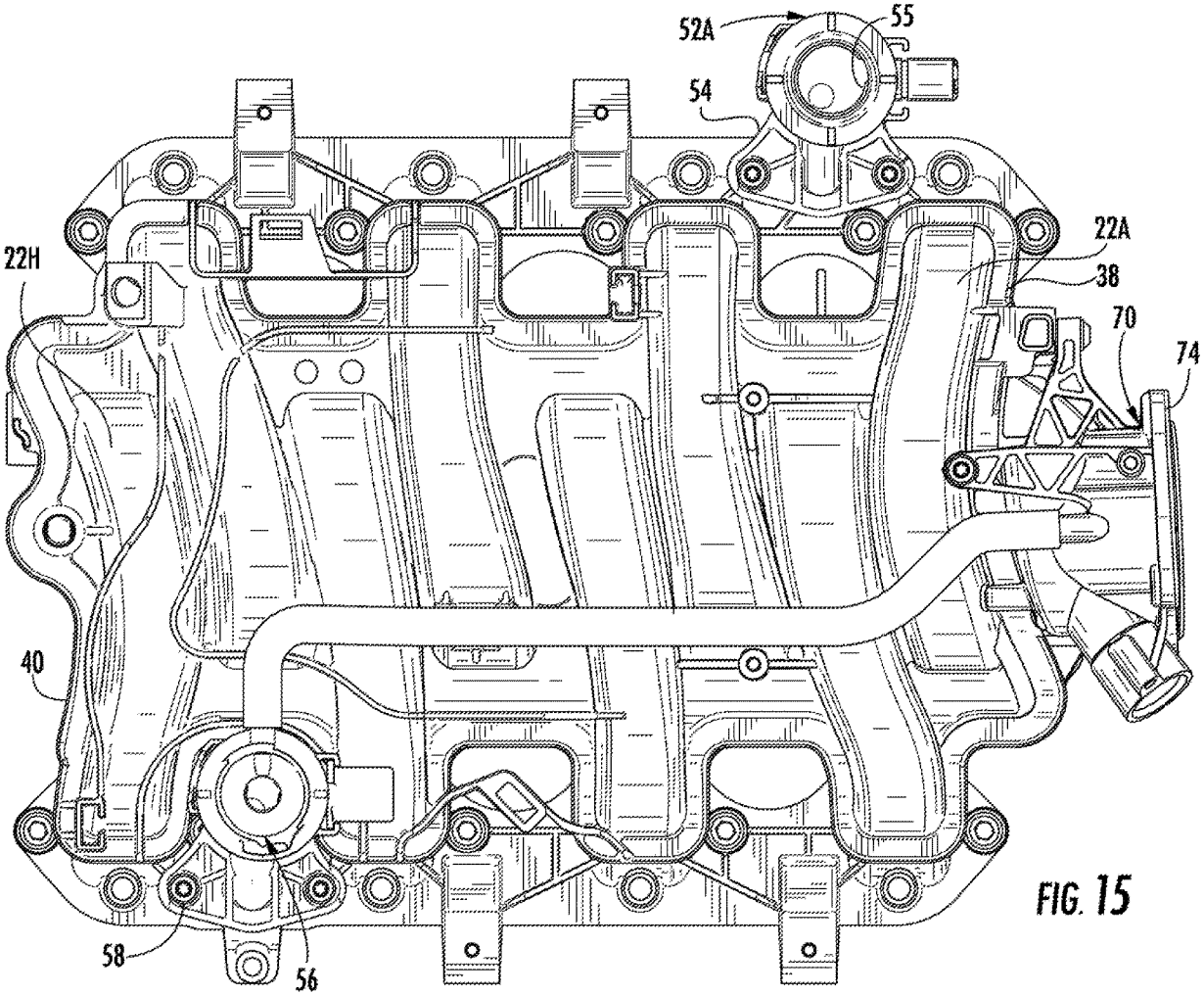
FIG. 15 is a top plan view of the intake manifold assembly of FIG. 12.
Figure 16:
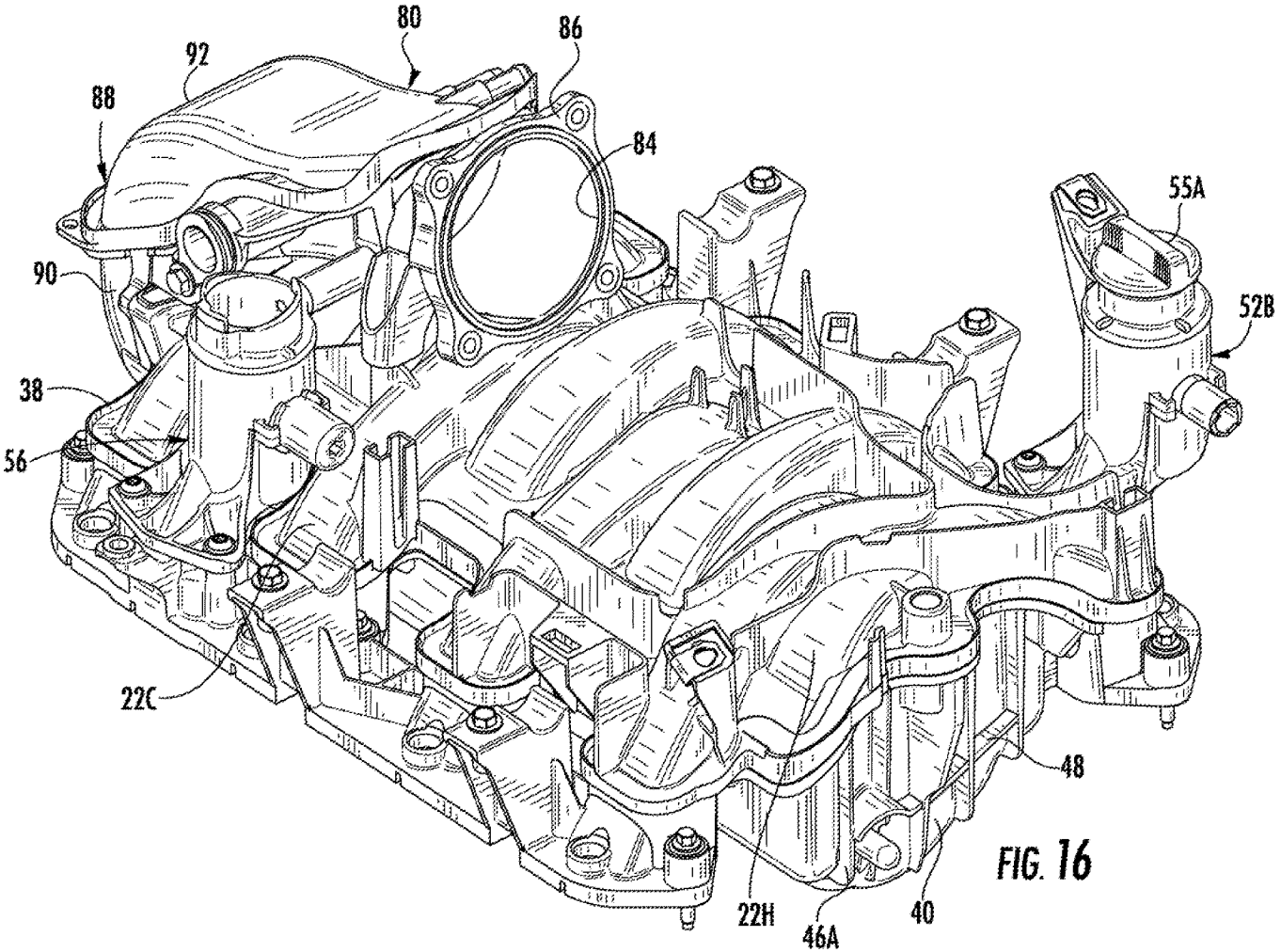
FIG. 16 is a perspective view illustrating a second configuration of an assembled intake manifold.
Figure 17:
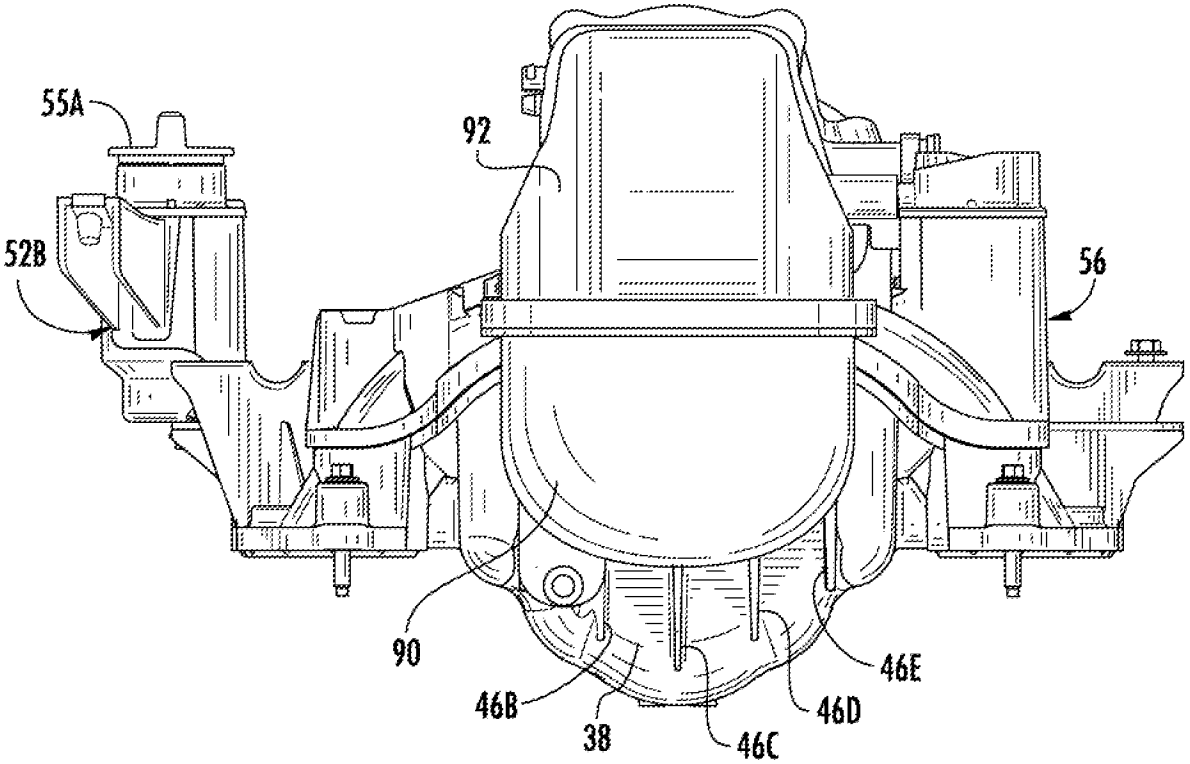
FIG. 17 is a rear elevation view of the intake manifold assembly of FIG. 16.
Figure 18:
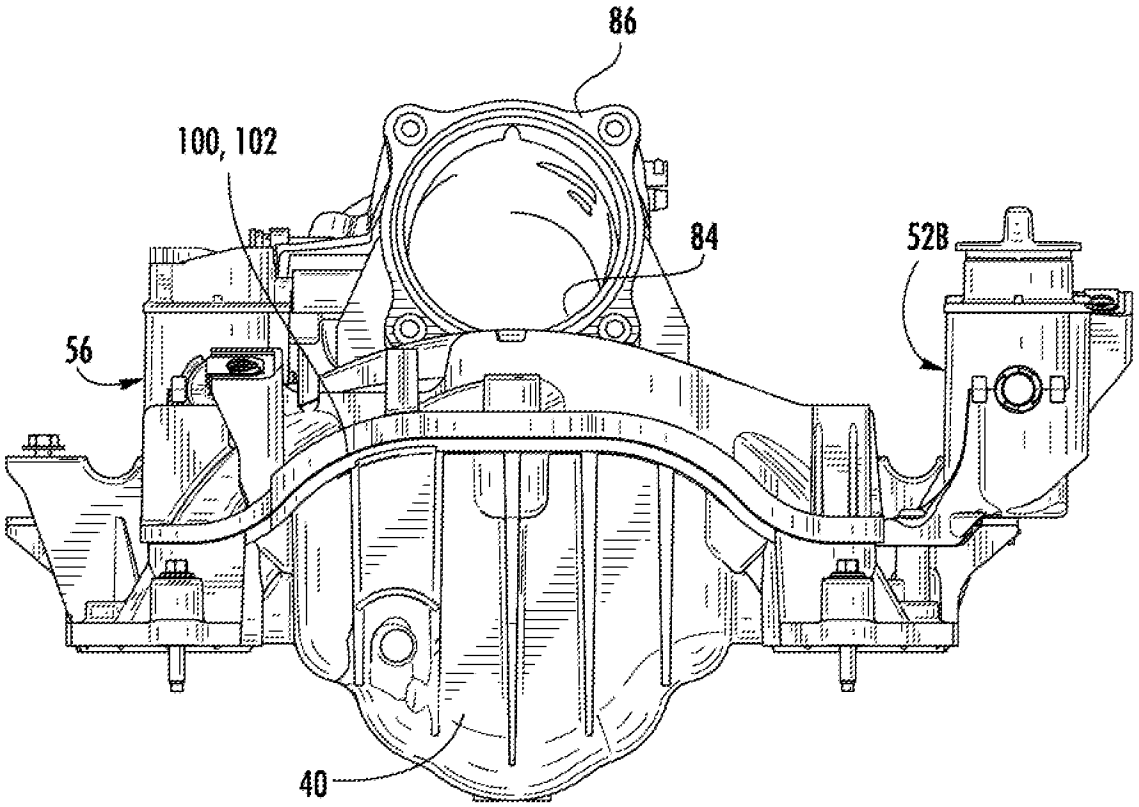
FIG. 18 is a front elevation view of the intake manifold assembly of FIG. 16.
Figure 19:
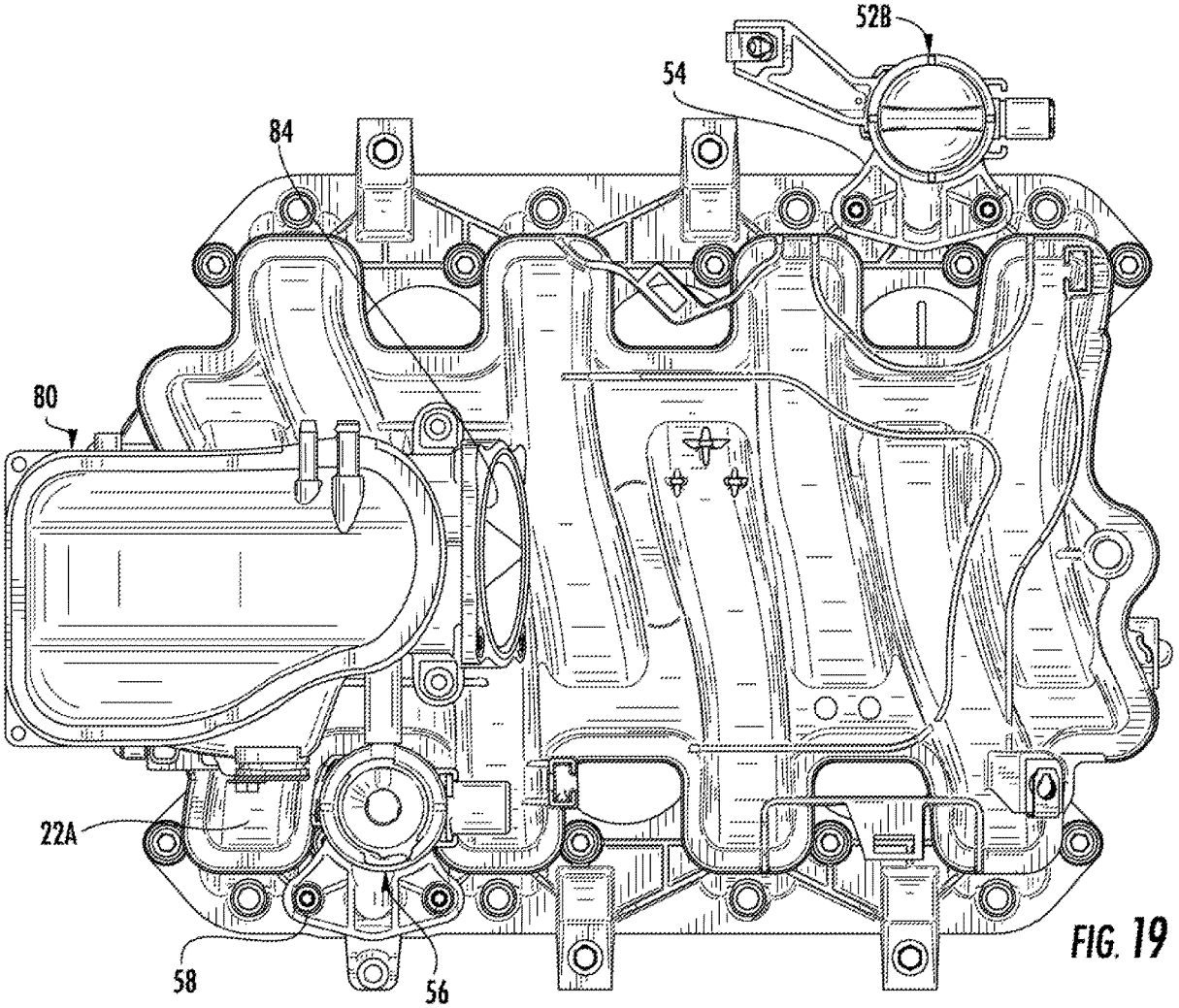
FIG. 19 is a top plan view of the intake manifold assembly of FIG. 16.

In the embodiments illustrated in FIGS. 12 and 19, the oil fill adaptors adaptor 52A and 52B are provided and located respectively for a car and a truck application. However, the neck portions of both adaptors are sized to have a single size for oil fill opening 55 and a single cap 55A, which contributes to flexibility and reduced manufacturing costs.

As noted earlier, the components illustrated in FIGS. 1 and 2 are common components used in all configurations and applications. of the configurable air intake manifold in all applications. The components in FIGS. 4 to 11 are selected and arranged according to the desired application. The assembly in FIGS. 12 to 15 is intended for a car application and assembly in FIGS. 16 to 19 is intended for a truck application.

Figure 6:
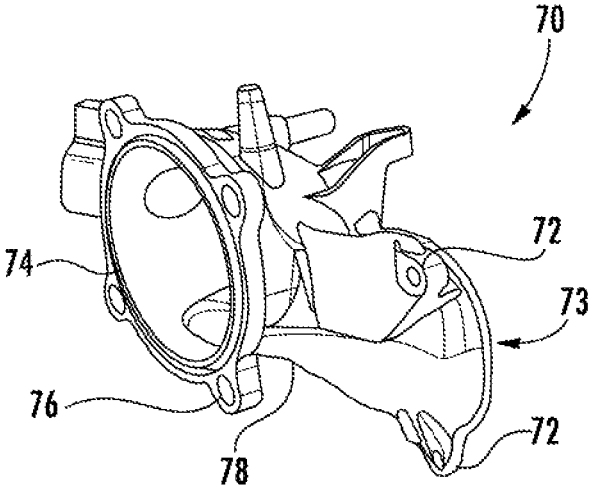
FIG. 6 illustrates a throttle body adaptor for the manifold assembly.
Figure 7:
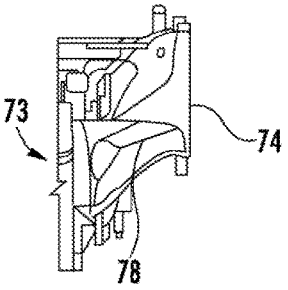
FIG. 7 is a side elevation view of the car throttle body adaptor of FIG. 6.
Figure 8:
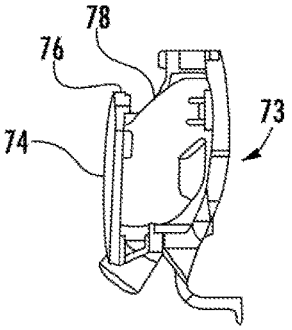
FIG. 8 is a bottom plan view of the car throttle body adaptor of FIG. 6.

FIGS. 6 through 8 illustrate a car throttle body adaptor 70 configured with mounting features 72 that surround a proximal open center 73 and align with the mounting features 33A through 33B of the lower shell 30 so that fasteners, preferably threaded, connect them together. The adaptor 70 has a distal open center 74 that communicates with the opposite open center 73 to define a through channel and is surrounded by the mounting flange 76. The neck 78 of adaptor 70 defines the through channel between the open centers 73 and 74. In the illustrated embodiment, the neck 78 extends laterally and vertically such that the openings 73 and 74 are offset from each other.

Figure 9:
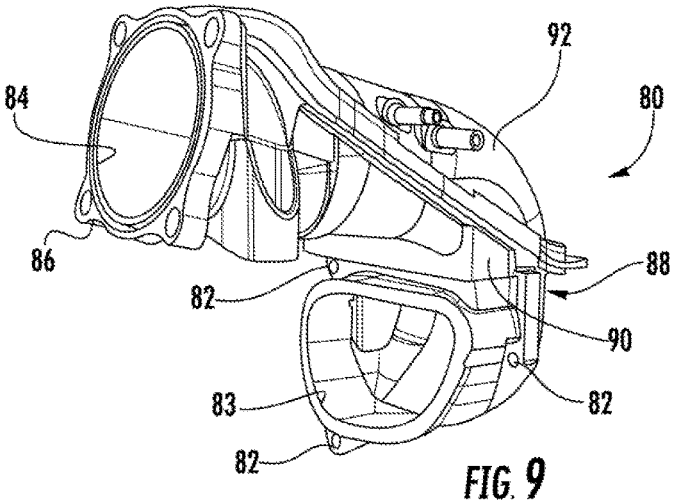
FIG. 9 illustrates a second throttle body adaptor for the manifold assembly.
Figure 10:
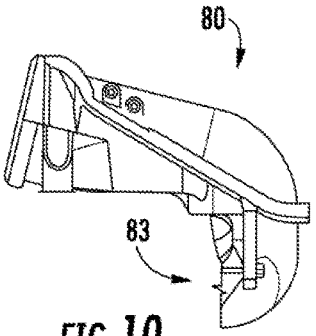
FIG. 10 is a side elevation view of the truck throttle body adaptor of FIG. 9.
Figure 11:
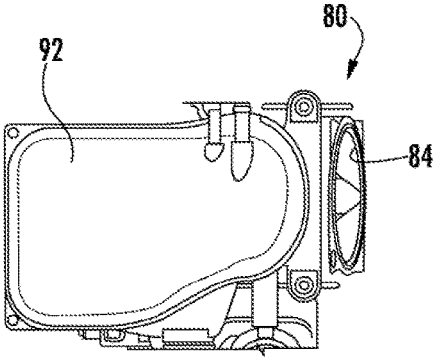
FIG. 11 is a top plan view of the truck throttle body adaptor of FIG. 9.

FIGS. 9-11 illustrate a truck throttle body adaptor 80 configured with mounting features 82 around a proximal open center or opening 83 for attachment to the mounting features 33A through 33B of the lower shell 30 so that fasteners, again preferably threaded, connect them together. The adaptor 80 includes a distal open center or opening 84, a flange 86 for mounting a throttle body (not shown), and a neck 88. The throttle body adaptor is formed from two parts, a lower part 90 and an upper part 92.

The open center 84 of the truck throttle body adaptor 80 is generally circular. The flange 86 circumscribes the open center 84 and may be considered an outer rim of the opening. The opening 84 and flange 86 are angled slightly upwardly.

In the illustrated embodiment, the neck 88 of the throttle body adaptor 80 bends in a J-shape. As shown in FIGS. 16-19, the J-shape of the neck 88 results in the opening 84 being positioned above the upper shell 20 and facing toward the closed end 40 of the shell 12.

In the assembled car configuration shown in FIGS. 12-15, the throttle body adaptor 70 is mounted to the throttle body mount 32 via fasteners extending through the respectively aligned mounting features 33 and 72 and the oil fill adaptor 52A is positioned near the intake end 38 of opened intake end 14.

In the assembled truck configuration shown in FIGS. 16-19, the throttle body adaptor 80 is mounted to the throttle body mount 32 via fasteners extending through the respectively aligned mounting features 33 and 82, and the oil fill adaptor 52B is positioned near the closed end 40.

In both the car and truck configurations, the selected opening 74 or 84 of the throttle body adaptor 70 or 80 is configured to face and open toward the front of the vehicle. However, due to the J-shape of the neck 88 of the truck throttle body adaptor 80, the throttle body mount 32 of the lower shell 30 is oriented in the opposite direction in the car and truck configurations. In the car configuration, the throttle body mount 32 and the intake end 38 of the lower shell 30 are positioned forward in a vehicle. Conversely, the truck configuration has the throttle body mount 32 and intake end 38 of the lower shell 30 positioned rearward in a vehicle. It should be noted that the whole shell 12, including inner shell 18 and the upper shell 20, are aligned with the lower shell 30 and are mounted in opposite orientations for the car and truck configurations, but the lower shell 30 is positioned in either configuration to mate with the OEM engine block.

For both the car and truck configurations, the oil fill adaptor 52 and the PCV adaptor 56 remain in substantially the same position relative to the vehicle engine compartment and direction of travel. In other words, installed manifold assembly 10, from a vehicle perspective (i.e., the perspective of FIGS. 13 and 18), has the oil fill adaptor 52 located in the front-right area of the intake manifold assembly and the PCV adaptor 56 is located in the rear-left area of the intake manifold assembly. As a result, the oil fill adaptor 52 and the PCV adaptor 56 are readily attachable to other engine components regardless of the installed orientation of the shell 12.

Due to the possibility that the present manifold assembly 10 may experience different loads or vibrations during use due as compared to an OEM manifold, the ribs 49-E and 48 provide structural reinforcement and distribute loads about the lower shell 30.

The various assembly configurations can be packaged and shipped as a specific kit. For example, a car kit may include the common components of the inner shell 18, upper shell 20, lower shell 30, oil fill adaptor 52, PCV adaptor 56, and throttle body adaptor 70. For a truck kit, the common components listed above and throttle body adaptor 80 would be included, and the lower throttle body adaptor parts 90 and 92 may be disassembled for shipping.

One skilled in the art will appreciate that having a majority of common components for multiple vehicles enables on-demand assembly and/or shipping of a kit and reduces costs related to inventory and handling.

In the construction of an assembly 10, the inner shell 18 is preferably secured in the lower shell 30 by a friction fit. As shown in FIGS. 2, 3, 14, and 18, the upper shell 20 and lower shell 30 are preferably joined by a continuous weld, and most preferably by vibration welding, at the interfaces 100 and 102. The upper shell 20 is affixed to the lower shell 30 by welding or similar means, preferably by vibration welding at the weld interfaces 100, 102. The weld interfaces 100, 102 extend continuously around a perimeter of the upper shell 20 and the lower shell 30. In a preferred embodiment, the single vibration welding operation between the upper shell 20 and the lower shell 30 is only weld needed for producing the entire manifold assembly 10. The remaining components of the assembly are all mechanically affixed to their respective mounting locations by various fasteners, such as screws and bolts.

What is claimed is:

1. A set of common components for a configurable intake manifold, comprising:

a base manifold having an intake end and a second end, including:

a lower shell having:

a throttle body mount located proximate the intake end and adapted to receive a throttle body flange, a first port located proximate the intake end, and a second port located proximate the second end, and an upper shell;

a removable PCV adaptor; and a removable oil fill adaptor, wherein the set is adaptable to be assembled in a configuration with the oil fill adaptor located in the first port, the PCV adaptor located in the second port, and the throttle body mount positioned in a vehicle forward of the second end, and wherein the set is adaptable to be assembled in a configuration with the oil fill adaptor located in the second port, the PCV adaptor located in the first port, and the throttle body mount positioned in a vehicle rearward of the second end.

* * * * *